US007144299B2

(12) United States Patent
Arana et al.

(10) Patent No.: US 7,144,299 B2
(45) Date of Patent: Dec. 5, 2006

(54) METHODS AND DEVICES FOR SUPPORTING SUBSTRATES USING FLUIDS

(75) Inventors: Leonel R. Arana, Phoenix, AZ (US); Terry L. Sterrett, Cave Creek, AZ (US); Devendra Natekar, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/125,605

(22) Filed: May 9, 2005

(65) Prior Publication Data

US 2006/0252354 A1 Nov. 9, 2006

(51) Int. Cl.
*B24B 1/00* (2006.01)

(52) U.S. Cl. ..... 451/28; 451/54; 451/364; 269/7; 29/559

(58) Field of Classification Search ..... 451/41, 451/28, 364, 365, 54; 269/7, 8, 266; 29/559; 252/62.51 R, 62.54
See application file for complete search history.

(56) References Cited

U.S. PATENT DOCUMENTS 3,660,949 A * 5/1972 Coes, Jr. ..... 451/364
3,953,013 A * 4/1976 Griffith et al. ..... 269/7
5,505,871 A * 4/1996 Harder et al. ..... 252/78.3
5,809,987 A * 9/1998 Wark et al. ..... 125/35
5,947,662 A * 9/1999 Becker et al. ..... 409/131
6,321,739 B1 * 11/2001 Roberts ..... 125/35
6,553,913 B1 * 4/2003 Wardlaw ..... 102/501
6,647,611 B1 * 11/2003 Zhang ..... 29/559
6,806,544 B1 * 10/2004 Liu ..... 257/414
2006/0046433 A1 3/2006 Sterrett et al. ..... 438/459

OTHER PUBLICATIONS

Mould et al., "A New Alternative for Temporary Wafer Mounting", 2002 GaAsMANTECH Conference, (4 pages).
Monkman, "The electrorheological effect under compressive stress," J. Phys. D: Appl. Phys. 28 (1995), pp. 588-593.
Takesue et. al., "Development and Experiments of Actuator Using MR Fluid," IEEE Annual Conference on Industrial Electronics Society, 2000, pp. 1838-1843.
Tian et al., "Particulate volume effect in suspensions with strong electrorheological response," Materials Letters 57 (2003), pp. 2807-2811.

(Continued)

*Primary Examiner*—Eileen P. Morgan
(74) *Attorney, Agent, or Firm*—Konrad Raynes & Victor, LLP; Allan S. Raynes

(57) ABSTRACT

Electronic device support and processing methods are described. One embodiment includes a method of processing an electronic device including solder bumps extending therefrom. The method includes providing at least one fluid selected from the group consisting of electrorheological fluids and magnorheological fluids on a support structure. The solder bumps extending from the electronic device are positioned in the fluid. The fluid is activated by applying a field selected from the group consisting of an electric field and a magnetic field to the fluid. The activated fluid mechanically holds the electronic device in place. A surface of the electronic device is polished while the electronic device is held in place by the activated fluid. The fluid is deactivated by removing the applied field from the fluid, and the electronic device is separated from the deactivated fluid. Other embodiments are described and claimed.

13 Claims, 6 Drawing Sheets

OTHER PUBLICATIONS

Lord Corporation, "LORD Rheonetic™ Magnetically Responsive Technology Silicon-Based MR Fluid MRF-336AG Product Bulletin" (2004), (2 pages).

Yakoh et al., "Application of Electro-Rheological Fluids to Flexible Mount and Damper Devices," Industrial Electronics Society, IECON 2000. 26th Annual Conference of the IEEE, vol. 3, Oct. 22-28, 2000, pp. 1815-1820.

Tian et al., "Mechanical property of electrorheological fluid under step compression," J Appl. Phys, vol. 92, No. 11, Dec. 1, 2002, pp. 6875-6879.

Sproston et al., "Electrorheological Fluids in Dynamic Squeeze Flow," Conference Record of the ICDL '96 12th Int'l Conf. on Conduction and Breakdown in Dielectric Liquids, Roma, Italy, Jul. 15-19, 1996, pp. 515-519.

Monkman, "Exploitation of Compressive Stress in Electrorheological Coupling," Mechatronics, vol. 7, No. 1, 1997, pp. 27-36.

Monkman, "Addition of solid structures to electrorheological fluids," J. Rheol 35(7), Oct. 1991, pp. 1385-1392.

Jordan et al., "Electrorheology," IEEE Transaction on Electrical Insulation, vol. 24, No. 5, Oct. 1989, pp. 849-878.

Hanaoka et al., "Effects of Electrode Surface Morphology on Electrical Response of Electrorheological Fluids," Proc. of 13th Int'l Conf. on Dielectric Liquids (ICDL '99), Nara, Japan, Jul. 20-25, 1999, pp. 418-422.

Block et al., "Electro-rheology," J. Phys. D: Appl. Phys. 21 (1988), pp. 1661-1677.

* cited by examiner

METHODS AND DEVICES FOR SUPPORTING SUBSTRATES USING FLUIDS

RELATED ART

Wafers formed from materials such as silicon may be processed to form various electronic devices having integrated circuits and diced into semiconductor chips. Handling of wafers or dies for operations such as backgrinding has proven difficult. Wafers and dies are typically formed from fragile materials, and if formed particularly thin, may be highly flexible. As a result, the use of conventional processing equipment for holding the wafer or die often results in damaging or breaking the wafer or die. Consequently, wafers or dies are typically mounted onto rigid support structures to inhibit damage to the wafer or die during grinding, and to support the thin wafer or die after grinding.

Two common support techniques for thin wafers or dies include using vacuum chucks and using adhesive bonding to rigid supports.

Vacuum chucks are generally effective for holding rigid substrates in place and can maintain a moderate bonding force. However, vacuum chucks tend to deliver an uneven bonding force and therefore may cause the thin wafer or die to either deform (which adversely affects the uniformity of the processing), or to break entirely. In addition, vacuum chucks do not work well on wafers or dies with uneven surfaces, such as those including C4 solder bumps. Furthermore, vacuum chucks do not typically maintain enough of a total bonding force to hold the wafer in place during high-shear processes such as backgrinding.

Adhesives may be used to bond wafers or dies to rigid support structures. However, adhesives are often difficult to remove. For some adhesives, such as resists, polyimides, and silicones, very long solvent soaks are required for the dismounting. UV(ultraviolet)-release adhesives are commonly used for wafer or die support. However, wafer or die dismounting from the support structure is not trivial, even after UV-irradiation of the UV sensitive adhesive. Complete elimination of the adhesive bond between the support and the wafer or die may be difficult to achieve due to one or more of the following: (1) shadowing from surface features (such as C4 solder bumps) leading to localized underexposure of the adhesive to the UV radiation, (2) cross-linking of the adhesive resin, (3) secondary surface adhesion forces, and (4) incomplete deactivation of the adhesive. Therefore, the stress and bending forces imparted to the wafer or die during the dismounting of the wafer or die from the adhesive may cause significant damage to the wafer or die itself, or to the circuitry on the wafer or die, particularly when brittle thin films are used.

BRIEF DESCRIPTION OF THE DRAWINGS

Embodiments are described by way of example, with reference to the accompanying drawings, which are not necessarily drawn to scale.

DETAILED DESCRIPTION

Figure 1:
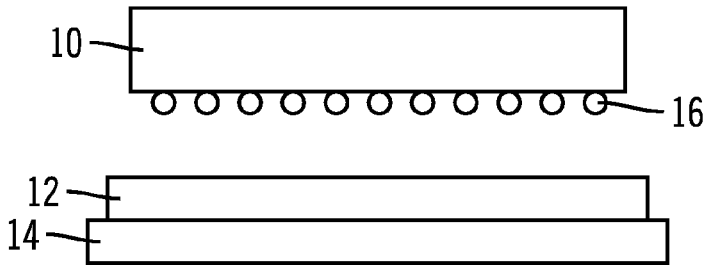
FIG. 1 PRIOR ART
FIGS. 1–7 illustrate a conventional process for supporting a wafer using a UV-release, pressure sensitive adhesive.
Figure 2:
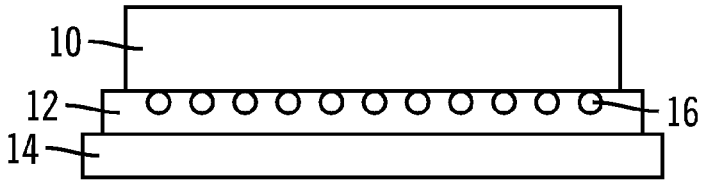
FIG. 2 PRIOR ART
Figure 3:
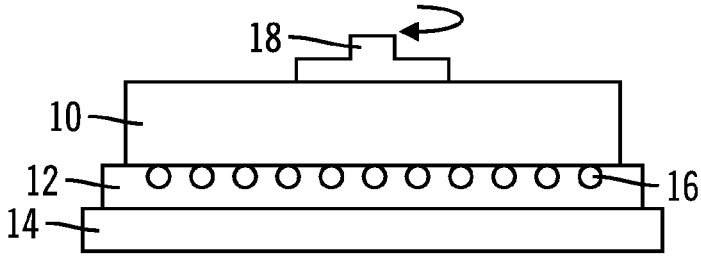
FIG. 3 PRIOR ART
Figure 4:
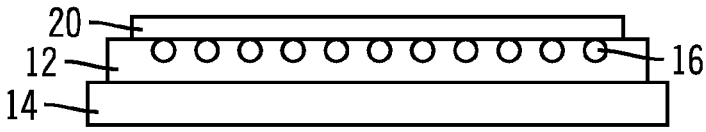
FIG. 4 PRIOR ART
Figure 5:
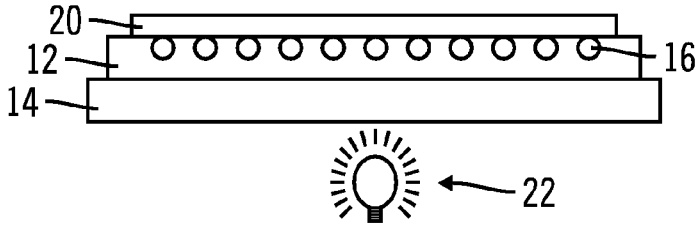
FIG. 5 PRIOR ART
Figure 6:
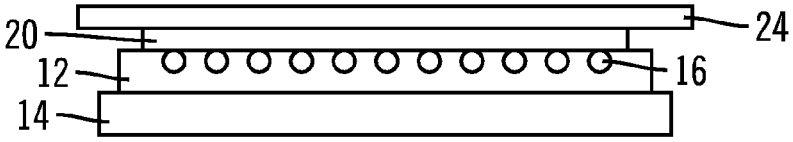
FIG. 6 PRIOR ART
Figure 7:
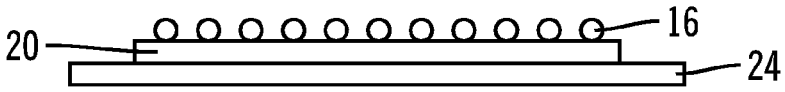
FIG. 7 PRIOR ART

FIGS. 1–7 illustrate a conventional process for utilizing a UV-release, pressure sensitive adhesive to enable temporary support of a wafer during a process such as a backgrinding operation. As seen in FIG. 1, the UV-release, pressure sensitive adhesive 12 is positioned on a support 14, which may be formed from a variety of materials, for example, glass. The wafer 10 may include a plurality of contacts such as solder bumps 16 extending therefrom. The wafer 10 is then brought into contact with the adhesive 14 and a bond is formed, as illustrated in FIG. 2. The supported wafer is then processed, for example, by using a polishing wheel 18 to perform a backgrinding operation, as illustrated in FIG. 3. The backgrinding operation results in the formation of a thinned wafer 20 that is still supported by the adhesive 12 on the support 14, as illustrated in FIG. 4. The adhesive 14 is then irradiated with UV light 22 through the support structure 14 to reduce the bonding strength of the adhesive 12. A dicing tape 24 is then applied to the surface of the thinned wafer 20 and the thinned wafer 20 is removed from the adhesive 12 and the support structure 14. The thinned wafer 20 is then cleaned and readied for dicing if necessary. However, as noted earlier, even after the exposure to UV light to irradiate the adhesive, it can be difficult to remove the thinned wafer from the adhesive without causing damage to the wafer and/or any circuitry on the wafer.

Certain embodiments utilize a fluid that can be made solid when activated by an appropriate field. Such fluids include electrorheological (ER) fluids and magnetorheological (MR) fluids. When the appropriate field is applied, particles within the fluids will typically arrange themselves into fibrous-like structures parallel to the applied field. This is manifested as a transition from a liquid to a solid and includes an increase in viscosity of, for example, a factor of up to $10^5$. Such fluids have been described as having potential applications including clutches, valves, damping devices and artificial muscle.

ER fluids are typically suspensions of dielectric particles having a size of about 0.1 μm to about 100 μm in a dielectric carrier fluid. Particles with a dielectric constant larger than that of the base fluid are typically used so that an external electric field will polarize the particles. These polarized particles interact with each other and form chain-like or lattice-like arrangements within the carrier fluid. The response time of ER fluids is typically on the order of 1–10 milliseconds.

MR fluids are suspensions of magnetizable particles having a size of about 1 μm in a carrier fluid. In the presence of a magnetic field, such magnetizable particles interact with each other and align into chain-like structures. The response time of MR fluids is typically on the order of about 10 milliseconds.

Figure 8:
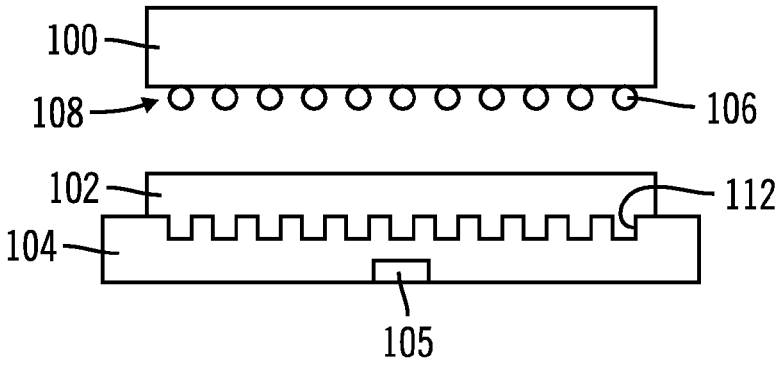
FIG. 8 illustrates forming a fluid layer on a support structure in accordance with certain embodiments.

FIGS. 8–13 illustrate a process in accordance with certain embodiments. As seen in FIG. 8, a fluid layer 102 is deposited on a support structure 104. A field generator 105 is coupled to or positioned near the support structure 104. The fluid may include at least one fluid selected from the group of an ER fluid and an MR fluid. The support structure 104 may have a variety of geometries and be formed from a variety of materials. A substrate 100 having some sort of a textured surface 108 is also provided. The textured surface 108 may be formed into the substrate or may be formed on the substrate, such as solder bumps 106 as illustrated in FIG. 8. The substrate 100 may comprise a wafer, die, package, or other type of body.

Figure 9:
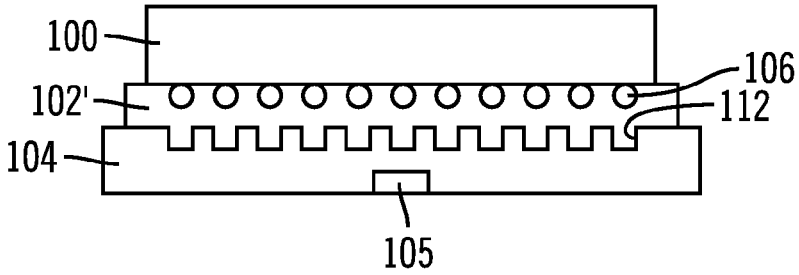
FIG. 9 illustrates pressing a wafer against the fluid and then activating the fluid to hold the wafer in a fixed position in accordance with certain embodiments.

The substrate 100 is brought into contact with the fluid 102 while the fluid 102 is in the liquid state. The fluid 102 contacts the solder bumps 106 on the textured surface 108 of the wafer 100. The fluid is then activated by applying the appropriate field (electric, magnetic) from the field generator 105 to the fluid. The activated fluid 102' is solid in form and mechanically holds the wafer in place by solidifying between and around the solder bumps 106 (FIG. 9).

Figure 10:
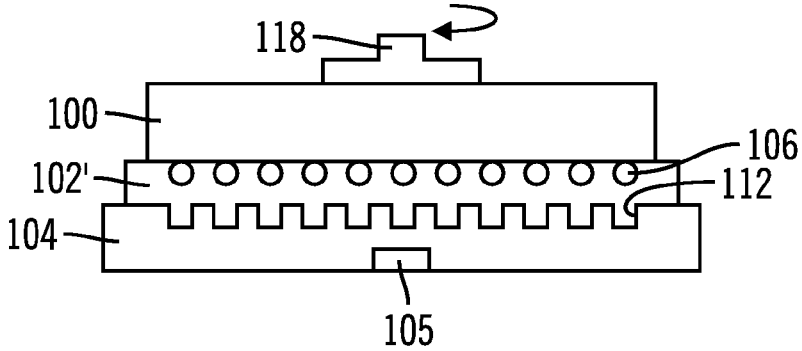
FIG. 10 illustrates a backgrinding operation on a wafer supported with the activated fluid in accordance with certain embodiments.
Figure 11:
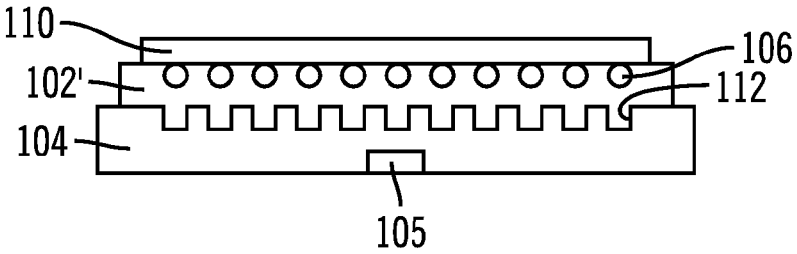
FIG. 11 illustrates a thinned wafer supported with the activated fluid after a backgrinding operation in accordance with certain embodiments.

The substrate 100 is then processed while being held in place by the activated fluid 102', which is in solid form. FIG. 10 illustrates a backgrinding operation on the substrate 100 using a polishing wheel 118. The substrate 100 is then thinned by the backgrinding operation to yield thin substrate 120 that is supported in place by the activated fluid 102', as illustrated in FIG. 11.

Figure 12:
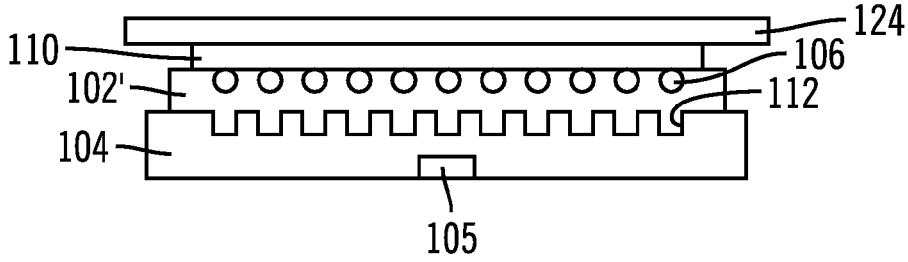
FIG. 12 illustrates applying a dicing tape to the thinned wafer supported with the activated fluid in accordance with certain embodiments.

Dicing tape 124 may then be applied if desired to the thinned substrate 120 supported by the activated fluid 102', as illustrated in FIG. 12. The dicing tape will be used to remove the substrate from the support structure 106 and fluid 102 after the fluid is deactivated.

Figure 13:
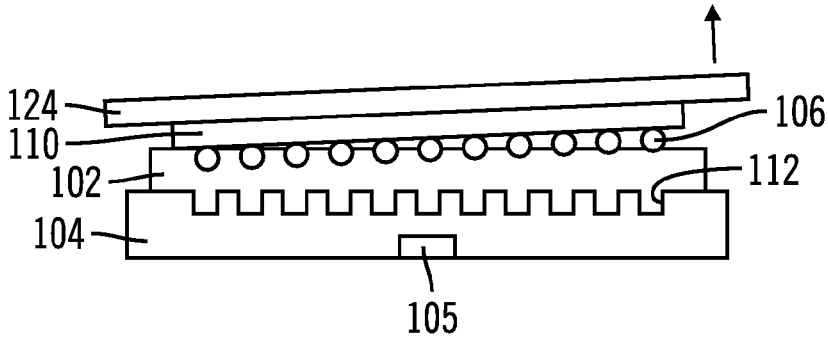
FIG. 13 illustrates deactivating the fluid so that the wafer can be released from the support in accordance with certain embodiments.
Figure 14:
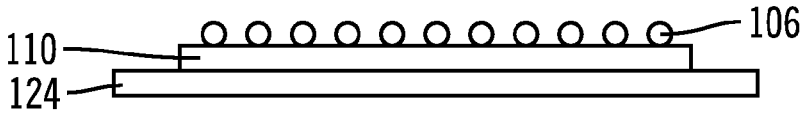
FIG. 14 illustrates the wafer removed from the support after being held using the fluid, in accordance with certain embodiments.

The activated fluid 102' is then deactivated by removing the applied field (electric, magnetic). The effect of removing the field is that the fluid transforms from a solid state to a liquid state. The substrate can then be readily removed from the fluid 102 and support 106, by, for example, lifting the dicing tape 124, as illustrated in FIG. 13. Removal of the substrate 120 from the fluid 102 (in liquid form) can be accomplished without imparting significant stresses to the substrate. As a result, damage to the substrate during removal from the support is inhibited. The substrate 120, coupled to the dicing tape 124 (as illustrated in FIG. 14), may then be cleaned if desired. If the substrate 120 is a wafer, the wafer may then be readied for dicing into individual chips, if appropriate.

In certain embodiments, the ER and MR fluids preferably meet the following criteria: (1) fast and reversible toggling between liquid and solid states, (2) a small adhesive force between the fluid (in liquid form) and corresponding structural surfaces, and (3) appreciable resistance of the activated fluid to deformation from compressive or shear stresses.

As noted above, ER and MR fluids have a fast and reversible transition from a liquid state to a solid state, for example, about 10 milliseconds or less for ER fluids and about 10 milliseconds for MR fluids. Thus, the dismounting of a substrate may be accomplished orders of magnitude faster that dissolution of the adhesive in a solvent. In addition, the removal process imparts less stress to the substrate than removal from a UV-irradiated, UV sensitive adhesive.

Regarding adhesive force, certain embodiments rely very little on the adhesive interactions between the fluid (in liquid form) and the surfaces to be held together. Instead, such embodiments rely more on the mechanical interlocking between the activated fluid and the surfaces to be held together. The rigidity of the activated fluid serves to inhibit relative motion between the fluid and the wafer in the xy plane, and the static friction forces between the fluid and the wafer (and between the fluid and the support structure) offer resistance to relative motion of the wafer in the direction normal to the wafer surface (z direction). The adhesion between the wafer and the non-activated fluid should generally not be too strong, or else separation of the wafer from the support structure after processing would be difficult. A slight adhesive interaction may be desirable when the processing imparts particularly strong forces that pull on the wafer in the z direction. This may occur to some extent during backgrinding, particularly on the edges of the wafer. The inherently high interfacial surface area between a wafer and the fluid (particularly when the wafer has textured surface features) may also favor some adhesive interaction.

Regarding yield stress, activated ER and MR fluids will generally behave as rigid solids when under an applied stress. However, when a critical stress level (the yield stress) is exceeded, the activated fluid will change states and flow like a liquid. Consequently, for effective wafer or die support during a process such as backgrinding, the yield stress of the activated fluid must exceed the stress imparted on the wafer during processing. It is believed that activated ER and MR fluids are very rigid under compressive stress. However, it is believed that activated ER and MR fluids are not as rigid under shear stress. As a result, in certain embodiments, the support structure and textured design of the substrate can be designed to take advantage of the high compressive yield stress. One example of such a support structure and substrate is described with reference to FIGS. 15–17.

Figure 15:
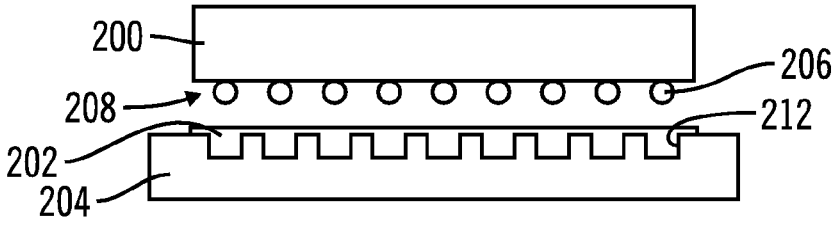
FIG. 15 illustrates a support structure having a fluid layer thereon in accordance with certain embodiments.
Figure 16:
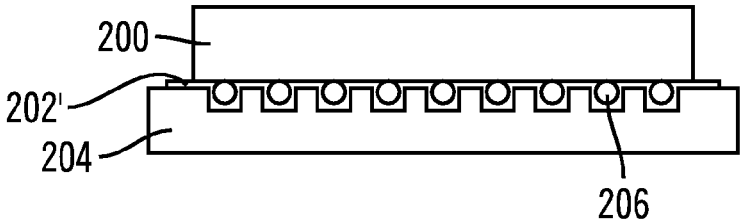
FIG. 16 illustrates the support structure of FIG. 15 including a substrate positioned thereon, in accordance with certain embodiments.
Figure 17:
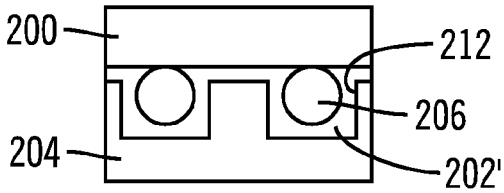
FIG. 17 illustrates a more detailed view of a portion of the structure of FIG. 16, in accordance with certain embodiments.

FIGS. 15 and 16 illustrate a substrate support 204 and substrate 200. The substrate 200 includes textured surface 208 that includes structures 206 extending therefrom. The structures 206 may be solder bumps in certain embodiments. The substrate support 204 has a textured surface including recesses 212 extending therein. The recesses 212 are designed to permit the fluid 202 to be positioned therein. The fluid 202 includes at least one of an ER and MR fluid. The recesses 212 are also sized to permit the structures 206 to fit inside and be surrounded by a quantity of the fluid 202 between the structures 206 and the sidewalls of the recesses 212. An appropriate field (electric, magnetic) is then applied to the fluid 202, and the fluid changes from liquid to solid state. As seen in FIG. 16, after the field has been applied, the fluid 202' is in the solid state. FIG. 17 shows an expanded view of a portion of FIG. 16, including the structures 206 positioned in the recesses 212, with space between the structures 206 and the sidewalls of the recesses 212. This type of layout will tend to position the structures 206 so that compressive forces are generated in the solid state fluid 202' between the structures 206 and the sidewalls of the recesses 212 during certain types of processing operations, for example, polishing and backgrinding.

Figure 18:
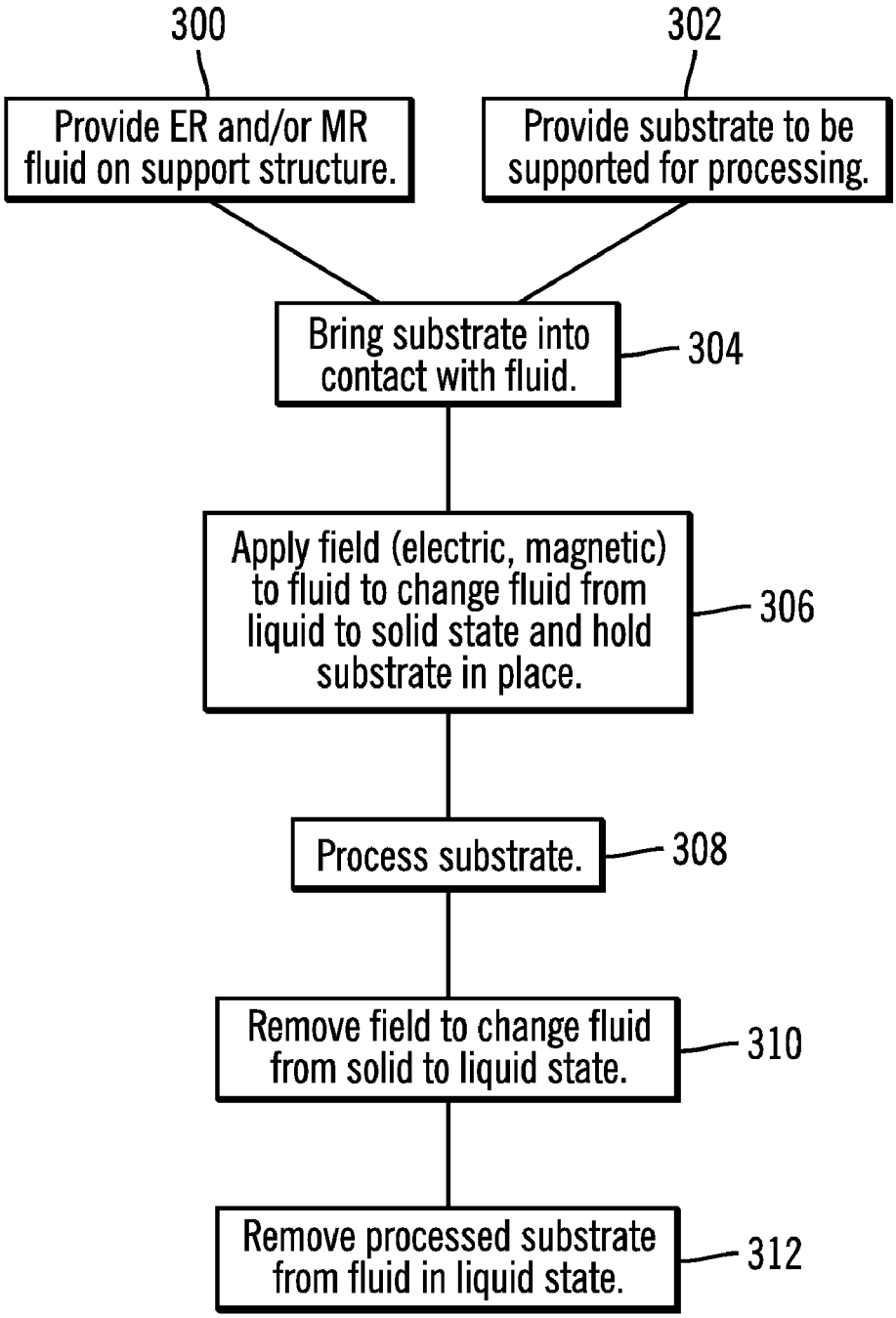
FIG. 18 is a flowchart illustrating a process for temporarily supporting a wafer in accordance with certain embodiments.

FIG. 18 illustrates certain embodiments in flow chart form including methods for supporting a substrate on a support structure using a fluid selected from ER and MR fluids. Block 300 is providing at least one of an ER or MR fluid in liquid form on a support structure. Block 302 is providing a substrate. The substrate may be, for example, a wafer, a die, or electronic package. Block 304 is bringing the substrate into contact with the fluid while the fluid is in liquid state. Block 306 is applying a field to the fluid, which changes the fluid from a liquid state to a solid state and holds the substrate in place. Depending on the fluid type, the field may be selected from at least one of an electric field and a magnetic field. Block 308 is processing the substrate. For example, processing may include a variety of operations, including, but not limited to, polishing the substrate, etching the substrate, and depositing additional layer(s) on the substrate. Block 310 is removing the applied field from the fluid, which has the effect of changing the fluid from the solid state to the liquid state. Block 312 is removing the substrate from the fluid, which may be done by lifting the substrate from the liquid fluid.

Certain embodiments use a fluid that includes only one of an ER or MR fluid. Other embodiments may use a fluid including both ER and MR fluids therein. The choice of fluid may depend on a variety of factors, including, but not limited to, the mechanical properties of the activated fluid, the ease of processing (for ex., supplying one field may be less complex than supplying two fields), and the speed of transformation desired (for ex., certain ER fluids may transform faster than certain MR fluids). ER and MR fluids may encompass a wide variety of materials, and may include a number of different materials mixed together. An ER or MR fluid in liquid form may in certain embodiments include particles dispersed in a dispersant. Additives including, but not limited to, thickeners, may also be present. Examples of commercially available MR fluids include MRF-241 ES, MRF 132-AD, and MRF336-AG, all available from Lord Corporation.

While certain exemplary embodiments have been described above and shown in the accompanying drawings, it is to be understood that such embodiments are merely illustrative and not restrictive, and that embodiments are not restricted to the specific constructions and arrangements shown and described since modifications may occur to those having ordinary skill in the art.

What is claimed is:

1. A method of supporting a body in a support, comprising:

providing at least one fluid in a liquid form on a support structure, the fluid selected from the group consisting of electrorheological fluids and magnetorheological fluids;

wherein the support structure includes a textured surface including openings sized to accept a quantity of the at least one fluid therein, and wherein the providing at least one fluid on the support structure includes positioning the at least one fluid on the textured surface of the support structure;

bringing a body into contact with the fluid in liquid form on the support structure;

wherein the body includes a textured surface, wherein the openings in the support structure textured surface are sized to also accept at least a portion of the body textured surface therein;

applying a field to the fluid in liquid form and transforming the fluid from the liquid form to a solid form, wherein the field includes at least one field selected from the group consisting of an electric field and a magnetic field, and wherein the body is held in place by the fluid in the solid form;

processing the body while the body is held in place by the fluid in the solid form;

removing the field from the fluid in solid form and transforming the fluid from the solid form to liquid form; and separating the body from the fluid in liquid form.

2. A method as in claim 1, wherein the processing the body includes polishing a surface of the body.

3. A method as in claim 1, further comprising forming the body from a semiconductor.

4. A method as in claim 1, wherein the textured surface of the body is formed to include solder bumps coupled to the body.

5. A method as in claim 1, wherein the at least one fluid is an electrorheological fluid.

6. A method as in claim 1, wherein the at least one fluid is a magnetorheological fluid.

7. A method as in claim 1, wherein the at least one fluid includes an electrorheological fluid and a magnetorheological fluid.

8. A method of supporting a body in a support, comprising:

providing at least one fluid in a liquid form on a support structure, the fluid selected from the group consisting of electrorheological fluids and magnetorheological fluids;

bringing a body into contact with the fluid in liquid form on the support structure;

wherein the body includes solder bumps extending therefrom, and wherein the bringing a body into contact with the fluid includes positioning at least part of the solder bumps within openings on the support structure;

applying a field to the fluid in liquid form and transforming the fluid from the liquid form to a solid form, wherein the field includes at least one field selected from the group consisting of an electric field and a magnetic field, and wherein the body is held in place by the fluid in the solid form;

processing the body while the body is held in place by the fluid in the solid form;

removing the field from the fluid in solid form and transforming the fluid from the solid form to liquid form; and separating the body from the fluid in liquid form.

9. A method as in claim 8, wherein during the processing the body while the body is held in place by the fluid in the solid form, the at least part of the solder bumps in the openings on the support structure are separated from the support structure by the fluid in the solid form.

10. A support structure adapted to support an electronic device, comprising:

a body adapted to support a fluid and an electronic device thereon;

a fluid positioned on the body, the fluid including at least one fluid selected from the group consisting of electrorheological fluids and magnetorheological fluids;

the fluid being adapted to be transformed from a liquid state to a solid state upon application of at least one field selected from the group consisting of electric and magnetic fields, the fluid also being adapted to be transformed from the solid state to the liquid state upon removal of the field; and at least one source adapted to apply at least one field selected from the group consisting of an electric field and a magnetic field, to the fluid on the body;

wherein the body includes a surface having recesses therein, wherein the recesses are sized to accept extensions extending from the electronic device that the body is adapted to support.

11. A support structure as in claim 10, wherein the at least one fluid is an electrorheological fluid.

12. A support structure as in claim 10, wherein the at least one fluid is a magnetorheological fluid.

13. A support structure as in claim 10, wherein the extensions extending from the electronic device comprise solder bumps.

* * * * *